US005149286A

United States Patent [19]

Tsujii

[11] Patent Number: 5,149,286

[45] Date of Patent: Sep. 22, 1992

[54] TILTING DEVICE FOR MARINE PROPULSION UNIT

[75] Inventor: Eiichiro Tsujii, Hamamatsu, Japan

[73] Assignee: Sanshin Kogyo Kabushiki Kaisha, Shizuoka, Japan

[21] Appl. No.: 710,590

[22] Filed: Jun. 5, 1991

[30] Foreign Application Priority Data

Jun. 5, 1990 [JP] Japan ..... 2-145482
Sep. 13, 1990 [JP] Japan ..... 2-241331

[51] Int. Cl.[5] ..... B63H 5/12

[52] U.S. Cl. ..... 440/61; 92/62

[58] Field of Search ..... 92/61, 62, 75, 129, 92/151; 440/49, 53, 61, 900, 111, 54; 114/271, 274, 280, 282, 284–286

[56] References Cited

U.S. PATENT DOCUMENTS 3,168,853 2/1965 Prince ..... 92/62
3,312,146 4/1967 Quere ..... 92/62
3,719,041 3/1973 Barnard ..... 92/62
3,958,443 5/1976 Fujita ..... 92/62
4,784,625 11/1988 Nakahama ..... 440/61
4,957,457 9/1990 Probst ..... 440/61

*Primary Examiner*—Sherman D. Basinger
*Assistant Examiner*—Clifford T. Bartz
*Attorney, Agent, or Firm*—Ernest A. Beutler

[57] ABSTRACT

A hydraulic arrangement for controlling tilt and trim of an outboard drive. The hydraulic arrangement comprises a single cylinder assembly having a single bore inside wherein an upper portion of the bore has a relatively small diameter and a lower portion of the bore has a larger diameter. Two separate pistons, one in each bore portion, are supported for reciprocation. The smaller diameter piston has a piston rod that is directly connected to an element of the outboard drive, while the opposite end of the cylinder assembly housing is connected to an element affixed to an associated watercraft, so as to insure against any undesirable noise or undue wear in the system, and to afford a compact assembly.

31 Claims, 10 Drawing Sheets

TILTING DEVICE FOR MARINE PROPULSION UNIT

BACKGROUND OF THE INVENTION

This invention relates to a tilt mechanism for marine propulsion devices and more particularly to an improved tilt and trim unit for an outboard drive.

As is well known, outboard drives such as outboard motors and the outboard drive unit of an inboard-outboard assembly are normally pivotal about a horizontally disposed axis. Pivotal movement about this axis is employed to provide a trim adjustment for the position of the outboard drive and also so as to permit the outboard drive to be tilted up clear of the water. For convenience, it has been proposed to employ hydraulic arrangements for moving the outboard drive both through the trim adjustment and also for tilting the outboard drive up out of the water. Many of these hydraulic tilt and trim assemblies use a trim cylinder having a piston that engages a portion of the outboard drive and is effective to pivot it through a small range of trim adjustment positions. A further hydraulic cylinder is normally employed and which is generally connected to both the transom of the watercraft and to the outboard drive for raising the outboard drive to a tilted up position. From the nature of the prior art arrangements, it is necessary to have the piston rod of the trim cylinder in mere abutting relationship with the outboard drive. As a result, there is a likelihood of relative movement between the drive and the piston rod, particularly when it is in its extreme positions, which can result in noise, wear and other associated problems.

To overcome such problems, the applicant of this invention has disclosed a tilting/trimming device having a single cylinder assembly with two separate hydraulically separated cylinder bores in which separate pistons are supported for reciprocation. Each piston has a piston rod that is directly connected to a corresponding element of the outboard drive so as to insure against any wear or play in the system and to afford a compact assembly (See Japanese Examined Patent Publication HEI2-5637).

However, since the device disclosed in HEI2-5637 employs two independent trimming and tilting cylinders, each with an upper and a lower chamber, it has been necessary to connect hydraulic pipings to all four of the upper and lower chambers of the device, and a complicated hydraulic operating circuit has been required.

Furthermore, with a trim and tilt device wherein both operations are carried out with a single cylinder, it has generally been necessary to carry out the slower trimming procedure before moving on to the relatively quicker tilting operation. Thus, it generally has not been possible to bypass altogether a trimming step and to quickly tilt an engine when it is not desirable to trim it.

It is, therefore, a principal object of this invention to provide an improved tilt and trim unit for a marine drive.

It is a further object of this invention to provide an improved and simplified tilt and trim unit, and associated hydraulic circuit, that will not result in the generation of noise and in which wear is minimized.

It is still a further object of the invention to provide a simplified tilt and trim unit allowing an operator to quickly tilt a drive unit, bypassing any trimming step where such a step is not necessary or desirable.

SUMMARY OF THE INVENTION

This invention is adapted to be embodied in an outboard drive assembly that includes a first element that is adapted to be affixed to an associated watercraft, a second element carrying a propulsion device, and means connecting the first and second elements. In accordance with the invention, means are provided for tilting the second element relative to the first element which include a housing member defining a fluid motor having a single bore extending through its length. The bore has first and second chambers, with the first chamber having a greater effective area than the second chamber. A first moveable member and a second moveable member are provided, with the first moveable member being disposed within one of the two chambers and the second moveable member disposed within the other of the two chambers. The first moveable member is engageable with the second moveable member. An elongated connector is fixed for movement with one of the two moveable members and extends to a position outside one end of the housing. Means are provided for connecting the elongated connector to either one of the first or second elements, and further, means are provided for connecting an end of the housing, opposite the end out of which the elongated connector extends, to the other of these two elements.

Another feature of this invention is adapted to be embodied in a reciprocatory motor for a marine propulsion unit tilting device. In accordance with this feature a first bore receives a first piston which is slidable for reciprocatory movement within the first bore. A second bore receives a second piston which is slidable for reciprocatory movement within the second bore. A third piston, adapted to abuttingly engage the first and second pistons, is also slidably received within the first bore for reciprocatory movement therein.

DETAILED DESCRIPTION OF THE PREFERRED EMBODIMENT

Figure 1:
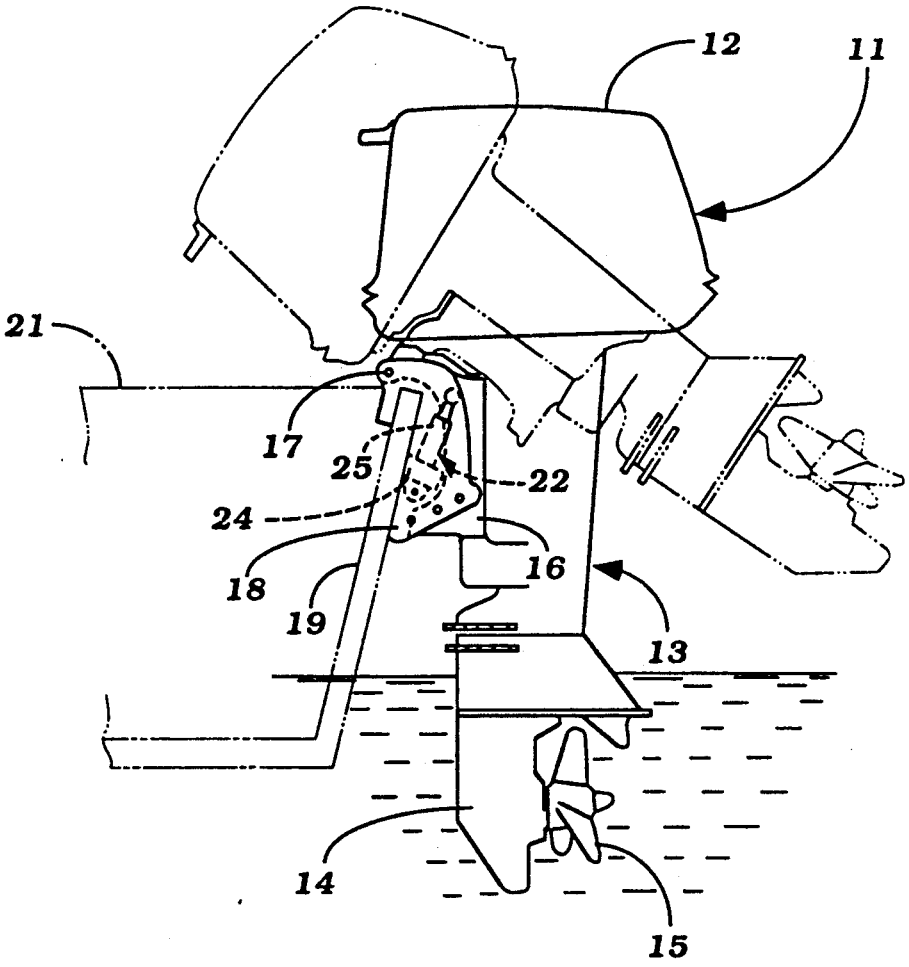
FIG. 1 is a side elevational view of an outboard motor and associated watercraft having a tilt an trim unit constructed in accordance with the invention.

Referring first to FIG. 1, an outboard motor having a tilt and trim unit constructed in accordance with this invention is identified generally by the reference numeral 11. Although the invention is described in conjunction with an outboard motor, as has been noted, it can be equally as well practiced in connection with the outboard drive portion of an inboard-outboard arrangement. The application of the invention to such an outboard drive of an inboard-outboard unit is believed to be readily obvious to those skilled in the art.

The outboard motor 11 includes a power head 12 in which an internal combustion engine is positioned. The engine drives a drive shaft that is rotatably journaled in a drive shaft housing 13 and which terminates in a lower unit 14 in a known manner. The drive shaft drives a propulsion device carried by the lower unit 14, in this case a propeller 15, in a known manner.

The drive shaft housing 13 is supported for steering movement about a vertically extending axis by means of a swivel bracket 16. The swivel bracket 16 is, in turn, supported for pivotal movement about a horizontally extending axis by means of a pivot pin 17 and clamping bracket 18. As is well known, the clamping bracket 18 permits attachment of the motor 11 to a transom 19 of a watercraft 21 (shown in phantom). The construction of the clamping bracket 18, swivel bracket 16 and the steering and tilting construction of the motor 11 are not described in any more detail because this portion of the construction is conventional.

A hydraulic tilt and trim assembly, indicated generally by the reference numeral 22, is interposed between the clamping bracket 18 and the swivel bracket 16 for controlling both the trim and tilt of the motor 11. The tilt and trim unit 22, as constructed in accordance with a first embodiment of the invention, is shown in cross-section in FIG. 2 and the hydraulic control circuit for it is shown schematically in FIGS. 3 and 4.

The tilt and trim unit 22 includes an outer housing assembly 23 that defines a lower, trim cylinder chamber, indicated generally by the reference numeral 24. Coaxially disposed with the trim cylinder chamber 24, the housing assembly 23 further defines an upper tilt cylinder chamber, indicated generally by the reference numeral 25. As will become more apparent, the trim cylinder chamber 24 is utilized to control small pivotal movements of the motor 11 so as to adjust the trim position of the motor, while the tilt cylinder chamber 25 is utilized to tilt the motor 11 up and out of the water, as shown in the phantom line view in FIG. 1.

The trim cylinder chamber 24 includes a cylinder bore 26, of relatively large diameter, formed in the lower portion of the housing 23. A trim piston 27 is slidably supported for reciprocation in the bore 26. The trim piston 27 has a passage 28 formed through its center which allows hydraulic fluid to pass therethrough under certain operating conditions, to be discussed below. One fluid passageway 29 is formed within the housing 23 at an upper region of the trim cylinder chamber 24, allowing hydraulic fluid to pass therethrough, and another such passageway 30 is formed within the housing 23 at a lower end of the trim cylinder chamber 24.

The tilt cylinder chamber 25 includes a cylinder bore 32 that is formed in the housing 23 concentrically with the cylinder bore 26. The cylinder bore 32 is of a substantially smaller diameter than the cylinder bore 26, however, the bore 32 extends for a substantially greater axial direction than does the bore 26. A fluid passageway 34 is formed within the housing at an upper region of the tilt cylinder chamber 25 in order to allow hydraulic fluid to pass therethrough. A tilt piston 36 is slidably supported within the bore 32 and has a piston rod 38 that extends through the upper end of the cylinder assembly 22.

The housing 23 is of a two-piece construction comprising an upper portion 40, within which the tilt cylinder bore 32 is formed, and a lower portion 42, within which the trim cylinder bore 26 is formed. The upper and lower portions 40 and 42 are securely adjoined together by any suitable means, such as by way of welds 44.

The lowermost end of the housing 23 is provided with an eyelet 46 so as to afford a detachable pivotal connection to a suitable portion of the clamping bracket assembly 18. The piston rod 38 is also formed with an eyelet 48 that is adapted to pass a pin for pivotally connecting the piston rod 38 to the swivel bracket 16.

Figure 3:
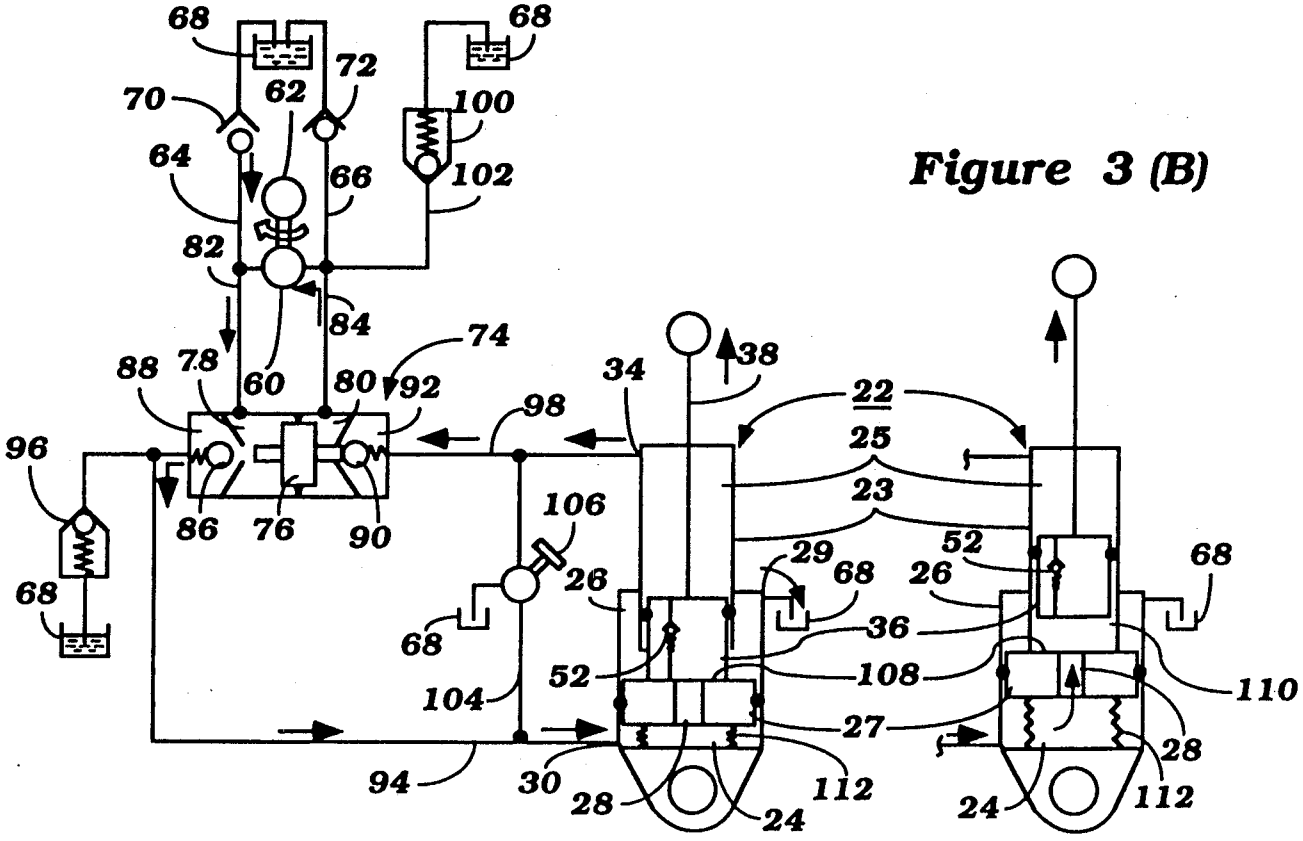
FIG. 3(A) is a schematic view showing the hydraulic system of the invention in the trim up mode.
FIG. 3(B) is a schematic view showing the hydraulic system of the invention in the tilt up mode.
Figure 4:
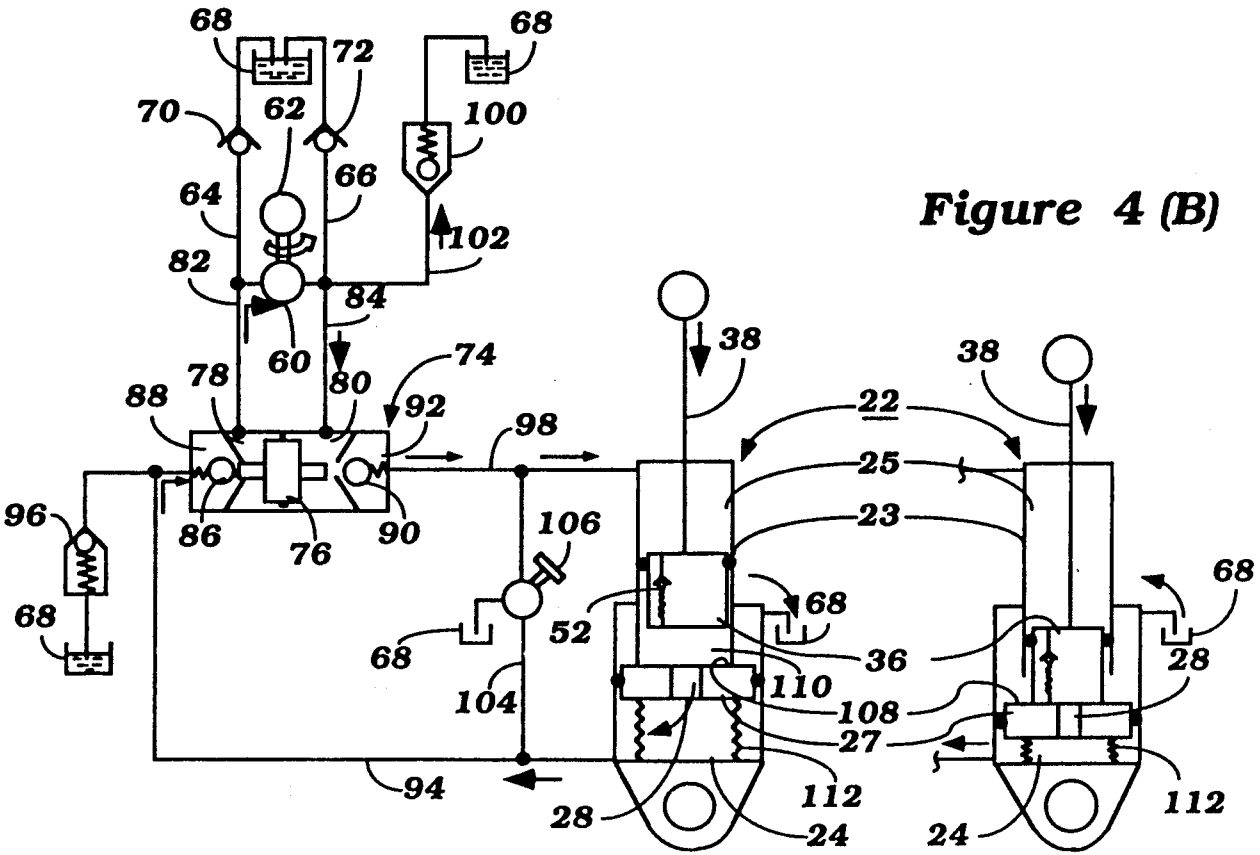
FIG. 4(A) is a schematic view showing the hydraulic system of the invention in the tilt down mode.
FIG. 4(B) is a schematic view showing the hydraulic system of the invention in the trim down mode.

The hydraulic system of the first embodiment, shown schematically in FIGS. 3 and 4, includes a reversible, positive displacement pump 60 which is driven by a reversible electric motor 62. The pump 60 is provided with a pair of inlet lines 64 and 66 that extend from a sump 68 and in which respective nonreturn check valves 70 and 72 are provided.

A shuttle valve assembly, indicated generally by the reference numeral 74, is provided downstream of the pump 60 and includes a shuttle piston 76 that divides the interior of the shuttle valve into first and second chambers 78 and 80. Pressurized fluid may be delivered from the pump 60 to the chamber 78 through a pressure line 82 or returned by this same line. In a like manner, the chamber 80 communicates with the opposite side of the pump 60 through a conduit 84.

A check valve 86 is provided in the chamber 78 and controls flow into yet a further chamber 88. In a similar manner, a check valve 90 controls the flow from the chamber 80 into a further chamber 92. The shuttle valve 76 has outwardly extending pin projections that are adapted to engage the balls of the check valves 86 or 90 so as to open these check valves, as will become apparent.

A pressure line 94 extends from the shuttle valve chamber 88 to the lower side of the trim cylinder chamber 24. A pressure relief valve 96 also communicates with the line 94 and with the sump 68. A line 98 communicates the shuttle valve chamber 92 with the tilt cylinder assembly 22 on a side above the tilt piston 36 and in communication with the tilt cylinder chamber 25.

A relief valve 100 is provided in a line 102 that communicates the junction of the lines 66 and 84 with the sump 68 so as to provide relief as will be described.

In order to provide manual tilt and trim adjustment, a line 104 communicates the tilt and trim piston chambers 24 and 25 with each other. A manually operated valve 106 is provided in the line 104 for either opening or closing this communication under manual operation.

FIGS. 3(A) and 3(B) show the condition of the mechanism during the trim up and tilt up modes, respectively. Assuming that the motor 11 is at a normal running position and that the manual valve 106 is closed, if the operator desires to provide a trim up adjustment, through a suitable control, he operates the motor 62 so as to drive the pump 60 in a direction wherein the line 82 is pressurized and the line 84 acts as a return line (FIG. 3(A)). When the line 82 is pressurized, the pressure in the chamber 78 will exceed the pressure in the chamber 80 and the shuttle piston 76 of the shuttle valve assembly 74 will be forced to the right from its previously neutral position. When the shuttle piston 76 is shifted to the right, its projection will unseat the ball check valve 90 and open communication between the shuttle valve chambers 80 and 92.

Pressurization of the chamber 78 causes the ball check valve 86 to open. Thus, the line 94 will be pressurized so that the trim cylinder chamber 24 will be pressurized, and the trim piston 27 is thereby caused to move in an upward direction toward the tilt cylinder chamber 25. This upward movement of the trim piston 27 is further imparted to the tilt piston 36, as the two pistons are in contact along a sealing surface 108 between their adjacent faces during this operation. Accordingly, the motor 11 is trimmed up by way of the piston rod 38 until the trim piston 27 reaches its upper stroke end. As the tilt piston 36 moves upwardly, along with the trim piston 27, the hydraulic fluid in the upper, tilt cylinder chamber 25 is discharged through the line 98 for return to the input side of the pump 60 through the shuttle piston chambers 92 and 80 and the line 84. Hydraulic fluid within the lower, trim cylinder chamber 24 is discharged through the passageway 29 and to the sump 68 as the trim piston 27 moves upwardly toward the end of its stroke.

It should be noted that the large diameter of the trim piston 27 causes the trim motion to be made at a relatively low rate of speed but with a relatively high force being applied to the motor 11.

If it is desired to tilt the motor up, the pump 60 is continued to be driven in the direction shown in FIG. 3(A). The pressurized hydraulic fluid continues to flow through the line 94 and into the trim cylinder chamber 24 (FIG. 3(B)). However, since the trim cylinder 27 can move upward no further, as it is positioned at the end of its stroke, the hydraulic fluid travels through the through passage 28 located centrally within the trim piston 27 and generates an upward force on the lower side of the tilt piston 36. Accordingly, the tilt piston 36 and the piston rod 38 are moved in an upward direction within the tilt cylinder chamber 25, thereby tilting up the motor 11. In the same manner as discussed above, as the tilt piston 36 moves upwardly, the hydraulic fluid in the upper, tilt cylinder chamber 25 is discharged through the line 98 for return to the input side of the pump 60 through the shuttle piston chambers 92 and 80 and the line 84.

It should be noted that the smaller diameter of the tilt piston 36 causes the tilt motion to be made at a relatively high rate of speed but with a relatively low force being applied to the motor 11. That is, the motor 11 can be tilted up quickly with a relatively small force sufficient only for holding up the motor 11.

When the motor is tilted all of the way up, there will be a rise in the pressure in the line 94 and the relief valve 96 will open so as to return fluid to the sump 68. At this point, the operator should then discontinue operation of the pump 60 and the motor 62. The motor 11 will be retained in its tilted up position by the hydraulic fluid contained within the trim cylinder chamber 24 and that portion of the tilt cylinder chamber 25 between the trim piston 27 and the tilt piston 36, denoted herein as the midway chamber 110.

The tilt and trim down operation will now be described by reference to FIGS. 4(A) and 4(B). Assuming that the motor 11 is in a tilted up condition, the piston 36 will be at the upper end of the cylinder bore 32. If the operator decides to tilt the motor down, the electric motor 62 is energized so as to drive the pump 60 in a direction to pressurize the line 84 and cause the line 82 to function as a pump return line (FIG. 4(A)).

When the line 84 is pressurized, the pressure in the chamber 80 of the shuttle valve assembly 74 will shift the shuttle valve to the left to unseat the ball check valve 86. The pressure in the chamber 80 is sufficient to unseat the check valve 90 so as to communicate the chambers 80 and 92 with each other, and thereby pressurize the line 98. Accordingly, pressure will be exerted in the tilt cylinder chamber 25 above the tilt piston 36. The tilt piston 36 will be forced downwardly, toward the trim cylinder chamber 24, to tilt down the motor 11 until the tilt piston 36 engages the trim piston 27 which had been kept at its upper stroke end by a spring 112 located along a lower end of the trim piston 27.

During downward movement of the tilt piston 36, a quantity of fluid is expelled from within the midway chamber 110, between the tilt piston 36 and the trim piston 27, through the through hole 28 of the trim piston 27 and out of the trim cylinder chamber 24 to the line 94. The return pressure is experienced in the shuttle valve chamber 88 and passes through the opened valve 86 into the chamber 78 to the pump return line 82.

However, due to the area displaced by the cylinder rod 38 itself within the tilt cylinder chamber 25, a lesser amount of hydraulic fluid is required in order to accomodate the increasing volume within the tilt cylinder chamber 25 above the tilt piston 36, as compared to the amount of fluid expelled from beneath the tilt cylinder, during downward movement of the tilt piston 36 during the tilt down operation. Further, the pump 60 is not able to accept, by way of return line input, the full quantity of fluid displaced from beneath the tilt piston 36, since the pump's output provides a lesser quantity of fluid to the portion of the tilt chamber 25 above the tilt piston 36 than the amount displaced beneath the tilt piston 36 during the tilt down operation. Thus, the trim piston 27 may be moved downward somewhat by the hydraulic fluid during this operation thereby allowing a quantity of fluid to escape from the region beneath the tilt piston 36 via the through passage 29 back to the sump 68, as indicated by the arrow of FIG. 4(A).

When the desired position is reached, the operator again stops the motor 62 and the outboard motor 11 will be retained in the desired position by the lockage of hydraulic fluid in the cylinder chambers.

When the hydraulic fluid is further delivered to the tilt cylinder chamber, after the motor 11 has been fully tilted down, the tilt piston 36 and the trim piston 27 are integrally pushed down to trim down the motor 11 until the trim piston 27 reaches its lower stroke end (FIG. 4(B)). Again, as just discussed above with reference to the tilt down operation, the hydraulic fluid in the lower trim cylinder chamber 24 is discharged through the line 94. As the trim piston 27 is moved downwardly during this operation make up fluid is supplied to the region of the trim cylinder chamber above the trim piston from the sump through the through passage 29.

If the motor continues to run in the tilt down condition once both pistons have reached the limits of their travel, the pressure in the line 84 will rise abruptly and the relief valve 100 will open to cause fluid pressurized by the pump 60 to be returned to the sump 68 through the line 102.

If at any time it is desired to manually tilt the motor 11 up, the manually operated valve 106 may be opened so as to open the communication between the chambers 24 and 25 through the line 104. When the valve 106 is opened, an upward force on the motor 11 will cause the piston rod 38 to move upwardly and displace fluid through the line 104 to the chamber 24. Closure of the valve 106 will then lock the motor 11 in its up position. In a like manner, opening of the valve 106 can permit the motor 11 again to be lowered manually under its own weight which will effectively displace fluid from the chamber 24 through the line 104 and into the chamber 25. Make up fluid can be obtained from, or excess fluid delivered to, the sump 68 with regard to any of the cylinder chamber regions as necessary during either of these operations.

Figure 2:
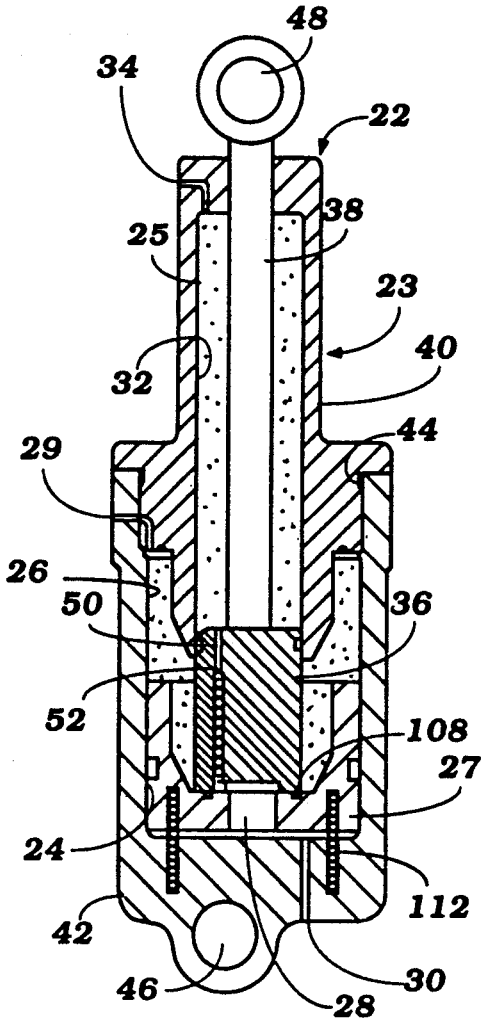
FIG. 2 is an enlarged cross-sectional view taken through the tilt and trim cylinder of the first embodiment of the invention.

In addition to providing tilting action, the tilt cylinder 25 and piston 36 assembly, along with the piston rod 38, provide a hydraulic damping operation. Such operation is illustrated schematically in FIGS. 5(A) and 5(B). A passage 50 is formed in the piston 36 for permitting flow from the upper, tilt chamber 25, above the tilt piston, to the region below the tilt piston 36. The passage includes a pressure responsive absorber valve 52 of the check type that permits flow in response to a predetermined force tending to cause the motor 11 to tilt or pop up (FIG. 5(A)). The amount of the force necessary to open the valve 52 is set, as is well known, to the desired value. Return flow from the region below the tilt piston 36 to the upper, tilt chamber 25 is permitted by opening the line 104 by way of the manual valve 106 (FIG. 5(B)). Like reference numerals of FIGS. 5(A) and 5(B) indicate like elements as shown in FIGS. 2 through 4.

Figure 5:
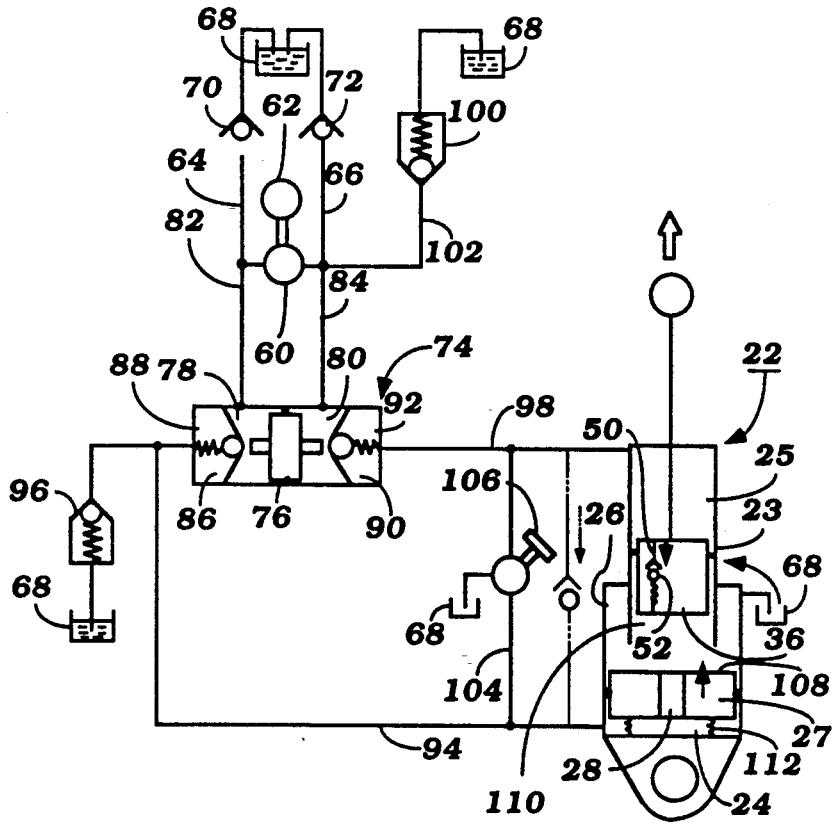
FIGS. 5(A) and 5(B) are schematic views showing the hydraulic system of the invention in a hydraulic damping mode.
Figure 5:
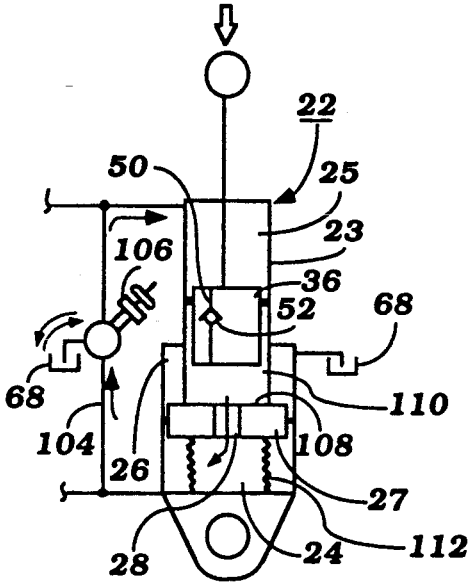

During the pop or tilt up condition as shown in FIG. 5(A), hydraulic fluid moves from the portion of the tilt chamber 25 above the tilt piston 36 to the region below the tilt piston 36 through the passage 50. Additional fluid is obtained from the sump 68 to make up for the greater volume increase in the region below the tilt piston 36 as compared to the volume decrease and fluid displacement in the region above the tilt piston 36. Additionally, the trim piston is moved upward during the pop up process as shown by the arrow.

During subsequent lowering of the engine 11 from the popped or tilted up condition, the volume of return fluid flow from the region below the tilt piston 36 exceeds the amount of make up fluid necessary to accomodate the increasing volume within the region above the tilt piston 36, due to the area displaced by the piston rod 38. Thus, excess fluid is returned to the sump 68, as shown in FIG. 5(B). Since the trim piston 27 is then positioned higher within the trim cylinder chamber 24 at this time, additional force is required to move it back down once it is engaged by the lower side of the tilt piston 36. Any make up fluid required is obtained from the sump 68.

Now, two additional embodiments shall be described with reference to the remaining Figures. Since many of the elements, and their operation, of the following embodiments are identical to that of the first embodiment, like reference numerals in the following embodiments indicate like elements as identified and explained in the first embodiment.

The second embodiment of the tilt and trim assembly will now be described with reference to FIGS. 6 and 7. The tilt and trim assembly of this embodiment is indicated generally by the reference numeral 200. As in the first embodiment, a two piece construction forms the housing assembly 23. However, in the second embodiment the portion of the housing 42 within which the larger diameter cylinder bore 26 is located and the portion of the housing 40 within which the smaller diameter cylinder bore 32 is located are securely adjoined together by way of a recess and flange arrangement 220 which interlock together.

The tilt cylinder assembly 25 of the second embodiment also provides for a hydraulic dampening operation, as does the first embodiment. However, in the second embodiment a passage 222 is provided in addition to the passage 50 through the tilt piston 36. Both passages are valved. The passage 50 includes a pressure responsive absorber valve 52 of the check type that permits flow from a portion of the chamber 25 on a side of the tilt piston 36 contacting the piston rod 38 to a portion of the chamber 25 opposite the piston rod 38 contacting side of the tilt piston 36 in response to a predetermined force tending to cause the motor 11 to tilt or pop up. FIG. 7 shows the position of the tilt piston 36 and rod 38 assembly under conditions wherein the motor 11 is fully tilted up. Return flow from the portion of the chamber 25 opposite the piston rod 38 contacting side of the tilt piston 36 is permitted by means of a passage 222 in which a return valve 224 is provided. The return valve 224 is adapted to open at a substantially lower pressure than the absorber valve 52, for example, the pressure generated by the weight of the outboard motor 11. In this way, the piston 36 may return to its normal trim condition when the force tending to pop up the motor 11 is removed. FIG. 6 shows the position of the tilt piston 36 and rod 38 assembly under conditions wherein the motor 11 is fully lowered.

Figure 6:
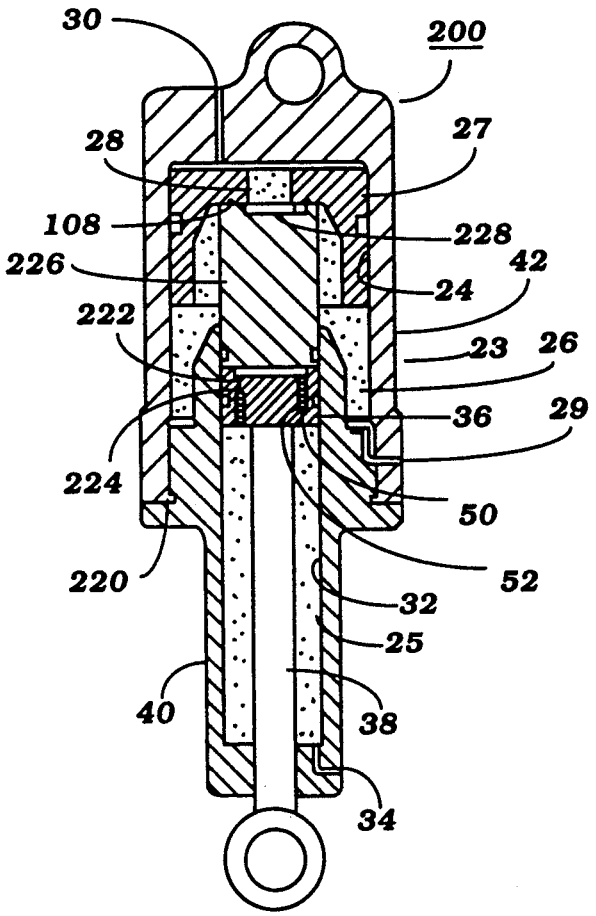
FIGS. 6 and 7 are enlarged cross-sectional views taken through the tilt and trim cylinder of a second embodiment of the invention.
Figure 7:
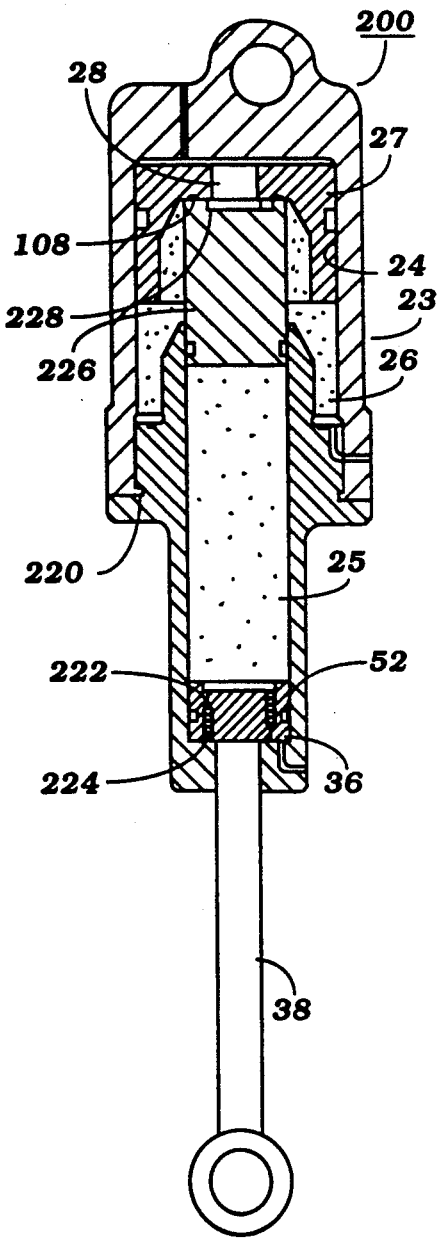

Additionally, in the second embodiment of FIGS. 6 and 7, a third piston 226 is held within the cylinder chambers 24 and 25 and is positioned between the tilt piston 36 and the trim piston 27. The third piston 226 has a diameter equivalent to that of the tilt piston 36 and is adapted for reciprocal movement within the cylinder chambers 24 and 25; but it should be noted that at least a portion of the third piston 226 always remains within the smaller diameter tilt cylinder chamber 25 throughout its realm of reciprocal movement. The third piston 226 is engageable with the trim piston 27 along a sealing surface 108. Concentrically within the region of the sealing surface 108, a recessed region 228 is formed within the third piston 226. This recessed region 228 faces the passage 28 within the trim piston 27.

When the motor 11 tilts or pops up, as when encountering an underwater obstacle, the third piston 226 essentially remains stationary within the cylinder housing 23 while the tilt piston 36 moves in response to the upward force upon the engine. Thus, when the engine lowers, for example by the weight of the engine 11 or the forward force provided by the propulsion unit, the tilt piston 36 lowers within the tilt cylinder chamber 25 until it reaches the third piston 226, whereat the tilt piston 36 comes to rest. Accordingly, the third piston 226 serves a memory function when the engine 11 pops up and then lowers, allowing the engine to reassume its former tilted or trimmed position.

During the pop up condition, make up fluid must flow into the portion of the tilt cylinder chamber 25 on the side of the tilt piston 36 facing the third piston 226 since this region experiences a greater volume increase over the amount of displaced fluid expelled from the tilt cylinder chamber 25 on the piston rod 38 side of the tilt piston 36. This is due to the volume displaced by the piston rod 38 itself. Such make up fluid enters the tilt cylinder chamber 25 via the through passageway 34. Conversely, upon lowering of the engine 11 after popping up, excess fluid is expelled from the region of the tilt cylinder chamber 25 on the piston rod 38 side of the piston 36, again via the through passage 34.

FIGS. 8 through 13 illustrate a third embodiment of the tilt and trim assembly, indicated generally by the reference numeral 300. It should be noted that the cylinder assembly 300 shown in these Figures is positioned in a horizontal fashion. Such horizontal positioning is employed when utilizing the invention in connection with the outboard drive portion of an inboard/outboard drive arrangement. In most respects, the embodiment of these Figures is like that of FIGS. 6 and 7. However, a difference is present in the means securely attaching the two portions 40 and 42 of the housing assembly 23 together. In the embodiment of FIGS. 8 through 13, the two housing portions 40 and 42 are secured together by a series of interlocking threads 302.

Figure 8:
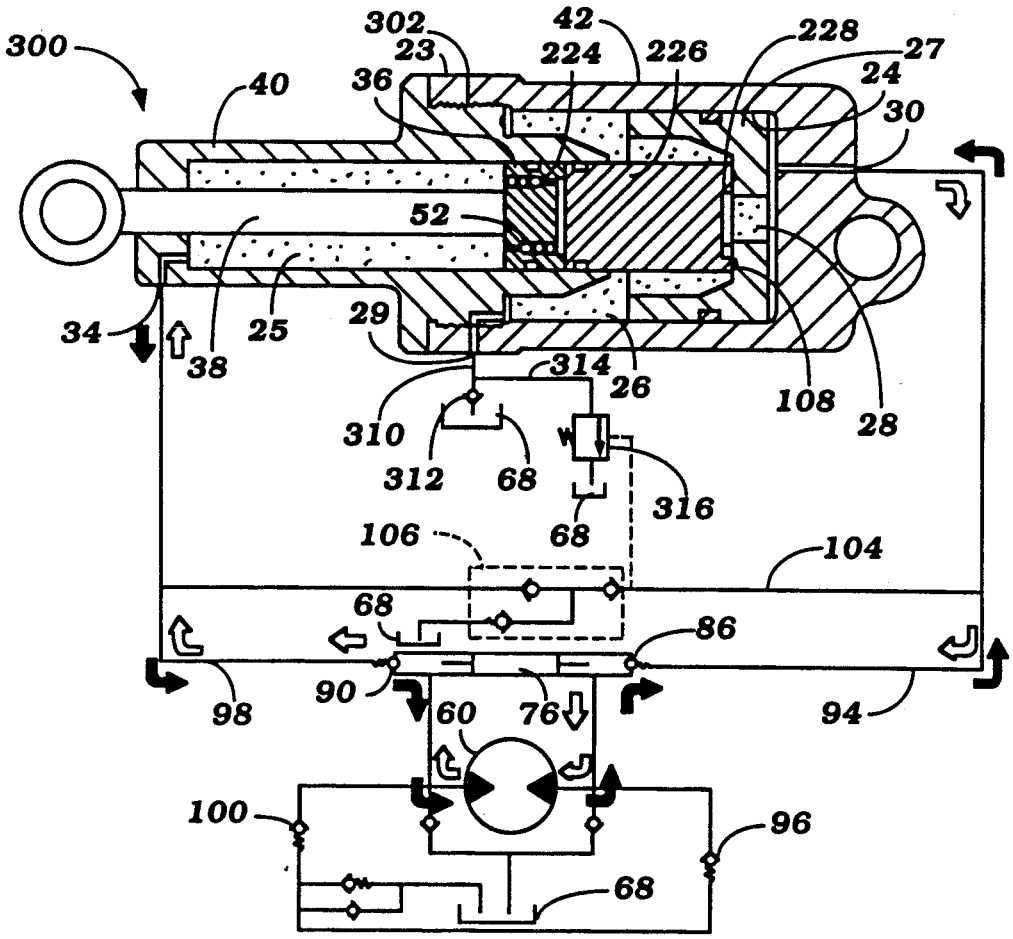
FIG. 8 is an enlarged cross-sectional view taken through the tilt and trim cylinder, and a partially schematic view of the hydraulic circuitry, of a third embodiment of the invention showing the invention in the tilt up and tilt down modes.
Figure 11:
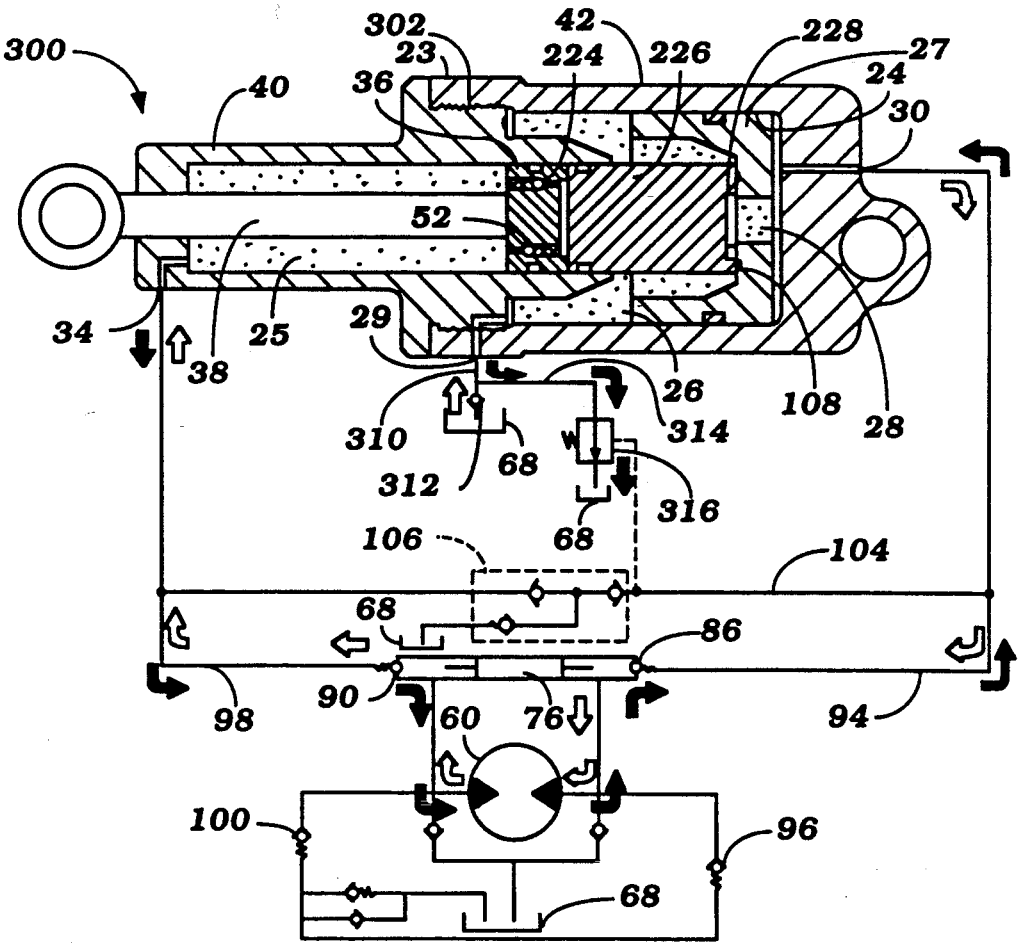
FIG. 11 is an enlarged cross-sectional view taken through the tilt and trim cylinder, and a partially schematic view of the hydraulic circuitry, of the third embodiment of the invention showing the invention in the trim up/tilt up and tilt down/trim down modes.

Additional hydraulic circuitry is employed in the third embodiment over that found in the first embodiment. This additional circuitry, shown schematically in FIGS. 8 and 11, is located between the passageway 29, which is positioned approximately centrally along the axis of the housing assembly 23 and communicates with a portion of the large diameter cylinder bore 26, and the sump 68.

A line 310 leads from the passageway 29 to the sump 68. A one way valve 312 is positioned along the line 310, and allows flow only in a direction leading away from the sump 68. Another line 314 is connected to the line 310 along a region between the passage 29 and the valve 312. The line 314 leads from the line 310 to the sump 68. A pressure operated unloader valve 316 is positoned along the line 314. The unloader valve 316 is operatively responsive to pressure within the line 104 and is positionable to either block the flow along the line 314 or to direct the flow into the sump 68.

Figure 9:
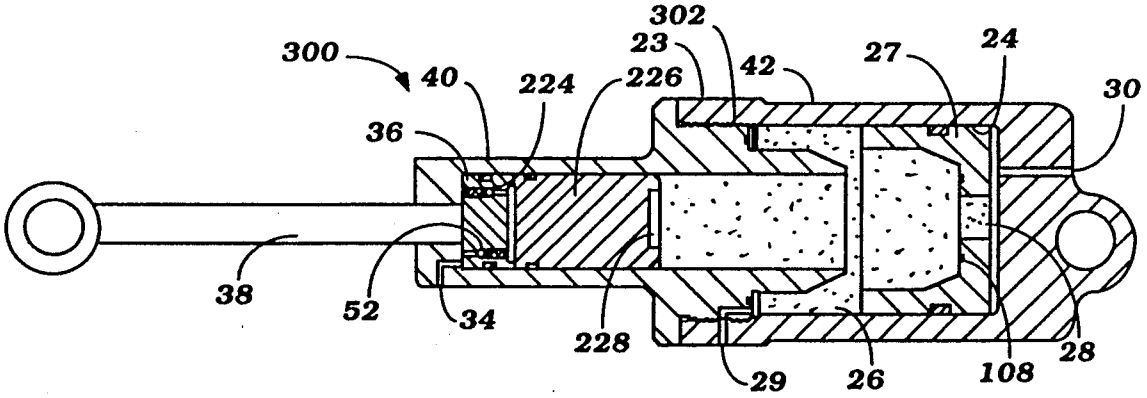
FIG. 9 is an enlarged cross-sectional view taken through the tilt and trim cylinder of the third embodiment illustrated in FIG. 8 showing the tilt and trim cylinder in the tilt up condition.
Figure 10:
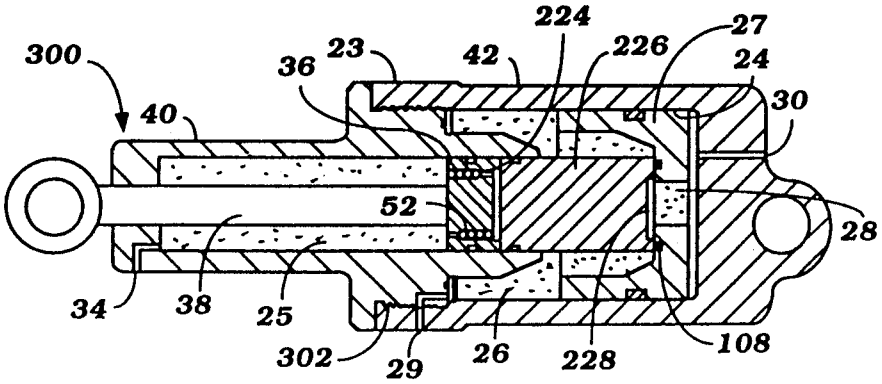
FIG. 10 is an enlarged cross-sectional view taken through the tilt and trim cylinder of the third embodiment illustrated in FIG. 8 showing the tilt and trim cylinder in the tilt down condition.

Now, with reference to FIGS. 8 through 10, the tilt up and tilt down operations of the third embodiment will be described. The blackened arrows of FIG. 8 show the flow path taken by the hydraulic fluid in the tilt up mode and the white arrows show the flow path taken by the hydraulic fluid in the tilt down mode.

Under operating conditions wherein there is no driving thrust provided by the propulsion unit, the unloader valve 316 remains closed to fluid flow toward the sump 68. In effecting a tilt up mode, hydraulic fluid flows into the large diameter cylinder bore 26 via the line 94 and the passage 30. Since the hydraulic fluid within the large diameter cylinder bore 26 has no route to escape, the trim piston 27 remains stationary. The pressure within the bore 26 is increased and the third piston 226, along with the tilt piston 36, is pushed in a direction toward the end of the tilt cylinder chamber 25. As a result the piston rod 38 is extended out of the housing assembly 23, as shown in FIG. 9, thereby tilting up the motor 11. Since no trim operation, which is relatively slow, is carried out during this procedure, the engine may be quickly tilted up.

Still under operating conditions wherein there is no driving thrust provided by the propulsion unit, the unloader valve 316 remains closed to fluid flow toward the sump 68. In effecting a tilt down mode, hydraulic fluid flows into the tilt cylinder chamber 25 via the line 98 and the passage 34. The tilt piston 36, along with the third piston 226, is pushed in a direction toward the end of the trim cylinder chamber 24. As a result the piston rod 38 is withdrawn into the housing assembly 23, as shown in FIG. 10, once the motor 11 tilts down. Again, since the relatively slow trimming down operation is bypassed, the engine 11 may be quickly tilted down by this procedure.

Figure 12:
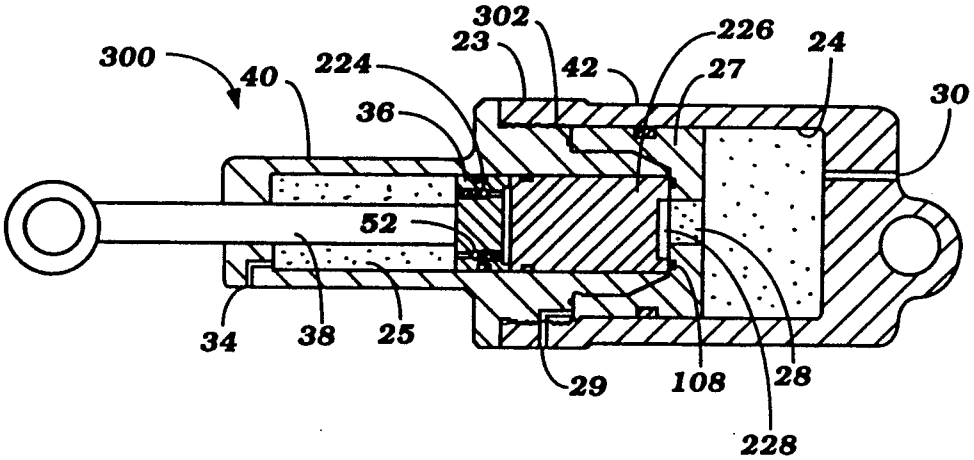
FIG. 12 is an enlarged cross-sectional view taken through the tilt and trim cylinder of the third embodiment illustrated in FIG. 11 showing the tilt and trim cylinder in the trim up condition.
Figure 13:
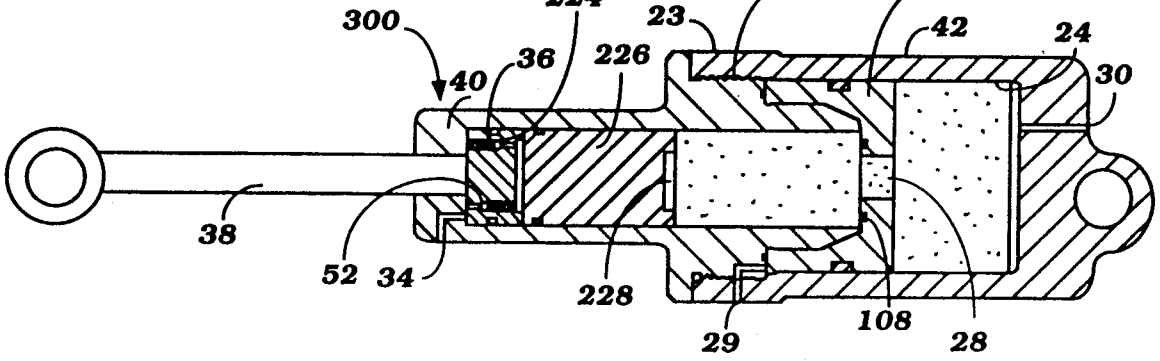
FIG. 13 is an enlarged cross-sectional view taken through the tilt and trim cylinder of the third embodiment illustrated in FIG. 11 showing the tilt and trim cylinder in the tilt up condition.

Now, with reference to FIGS. 11 through 13, the trim up/tilt up and tilt down/trim down operations of the third embodiment will be described. Such operations are generally carried out under conditions wherein the propulsion unit is providing a high driving thrust. The blackened arrows of FIG. 11 show the flow path taken by the hydraulic fluid in the trim up/tilt up mode and the white arrows show the flow path taken by the hydraulic fluid in the tilt down/trim down mode. A high driving thrust opens the valve 316 which allows fluid flow through the line 314 toward the sump 68. The valve 312 allows flow away from the sump 68 toward the passage 29, in these two modes.

In the trim up/tilt up mode, hydraulic fluid flows into the large diameter cylinder bore 26 via the line 94 and passage 30. Accordingly, pressure builds up within the trim cylinder chamber 24 and the trim piston 27 moves in a direction toward the tilt cylinder chamber 25. Hydraulic fluid is allowed to escape the trim cylinder chamber via the passage 29 and proceeds through the line 314 to the sump 68. Finally, the trim piston 27 reaches the end of its stroke, as is shown in FIG. 12.

As hydraulic fluid continues to enter through the passage 30 the continued pressure increase acts upon the end of the third piston 226 which thereby moves, along with the tilt piston 36, in a direction toward the end of the tilt cylinder chamber 25. As a result the piston rod 38 is extended out of the housing assembly 23, as shown in FIG. 13, thereby tilting up the motor 11.

In the tilt down/trim down mode, hydraulic fluid flows into the tilt cylinder chamber 25 via the line 98 and the passage 34. The tilt piston 36, along with the third piston 226, is pushed in a direction toward the end of the trim cylinder chamber 24. As a result, the piston rod 38 is withdrawn into the housing assembly 23 as the motor 11 tilts down. Once the third piston 226 engages the trim piston 27, the trim piston 27 is pushed in a direction towards the end of its cylinder chamber 24, and hydraulic fluid is allow to escape from the chamber 24 on a side of the trim piston 27 facing the end of the trim cylinder chamber 24 through the passage 30, and to fill the cylinder chamber on a side of the trim piston 27 facing the tilt cylinder chamber 25 via the passage 29. Accordingly, the motor 11 is thereby trimmed down.

Similar to the first embodiment of the invention, in the third embodiment it should be noted that the larger diameter of the trim piston 27 than the tilt piston 36 causes the trim motion to be made at a relatively lower rate of speed but with a relatively higher force being applied to the motor 11 than with the smaller tilt 36 and third 226 pistons.

It should be readily apparent from the foregoing description that an extemely compact noise and wear free tilt and trim assembly is provided for an outboard motor, or the outboard drive unit of an inboard-outboard motor. Although several embodiments of the invention have been illustrated and described, it is believed to be readily apparent to those skilled in the art that various changes and modifications may be made, without departing from the spirit and scope of the invention as defined by the appended claims.

It is claimed:

1. In an outboard drive assembly comprising a first element adapted to be affixed to an associated watercraft, a second element carrying a propulsion device and means connecting said first and said second elements, the improvement comprising means for tilting said first element relative to said second element comprising a housing means defining a fluid motor having a single bore extending through the length of said housing, said bore having first and second chambers, said first chamber having a greater effective area than said second chamber; and further, a first moveable member and a second moveable member, said first moveable member disposed within one of said two chambers and said second moveable member disposed within said other of said two chambers, said first moveable member being engageable with said second moveable member; and an elongated connector fixed for movement with one of said two moveable members and extending to a position outside one end of said housing; means for connecting said elongated connector to one of said first and second elements and means for connecting an end of said housing, opposite said end out of which said elongated connector extends, to the other of said first and second elements.

2. In an outboard drive assembly as set forth in claim 1 wherein said first chamber is coaxially disposed with respect to said second chamber.

3. In an outboard drive assembly as set forth in claim 1 wherein said housing means comprises two separate sections and means for securely fastening the two sections together.

4. In an outboard drive assembly as set forth in claim 1 wherein said first moveable member has a greater effective fluid contacting surface area than said second moveable member, and said first moveable member is disposed within said first chamber and said second moveable member is disposed within said second chamber.

5. In an outboard drive assembly as set forth in claim 4 wherein said first moveable member is provided with a passage located centrally through its lengthwise axis.

6. In an outboard drive assembly as set forth in claim 5 further including means for selectively pressurizing said first and second chambers for effecting movement of said first and second members, said means for pressurizing being effective to exert the same pressure on the moveable members so that said first moveable member disposed within said first chamber moves at a slower rate and at a higher force than said second moveable member disposed within said second chamber.

7. In an outboard drive assembly as set forth in claim 6 further including means for selectively depressurizing said first and second chambers.

8. In an outboard drive assembly as set forth in claim 7 wherein a passage is provided through a central region of said housing allowing hydraulic fluid to pass therethrough.

9. In an outboard drive assembly as set forth in claim 8 wherein said first and second chambers are cylinder chambers.

10. In an outboard drive assembly as set forth in claim 9 wherein said first and second moveable members are pistons; said first piston being a trim piston and said second piston being a tilt piston.

11. In an outboard drive assembly as set forth in claim 10 wherein said trim piston and said tilt piston are reciprocably disposed within said first and second cylinder chambers, respectively.

12. In an outboard drive assembly as set forth in claim 11 wherein said elongated connector is a piston rod.

13. In an outboard drive assembly as set forth in claim 12 wherein said piston rod is pivotally connected to one of said first and second elements; and said means for connecting an end of said housing, opposite said end out of which said piston rod extends, to the other of said first and second elements is a pivotal connection.

14. In an outboard drive assembly as set forth in claim 13 further including a valve means providing communication between opposite sides of one of the pistons for permitting the elements to pivot relative to each other at a restricted rate upon the application of a predetermined force.

15. In an outboard drive assembly as set forth in claim 14 further including manually operable valve means for selectively communicating the opposite sides of the single bore for providing for manual movement of the one element relative to the other element.

16. In an outboard drive assembly as set forth in claim 15 further comprising a third piston positioned between the tilt piston and the trim piston, and wherein said tilt piston is engageable with said trim piston by way of said third piston.

17. In an outboard drive assembly as set forth in claim 15 further including a biasing means postioned between the trim piston and an end portion of the first cylinder chamber, for providing a force upon the trim piston in a direction away from the end portion of the first cylinder chamber and towards the end of the stroke of the trim piston.

18. A reciprocatory motor for a marine propulsion unit tilting device comprising a first bore and a first piston received within said first bore, said first piston slidable for reciprocatory movement within said first bore; a second bore and a second piston received within said second bore, said second piston slidable for reciprocatory movement within said second bore; and a third piston, interposed between and adapted to abuttingly engage said first and second pistons, slidably received within said second bore for reciprocatory movement therein and having a portion adapted to extend into said first bore; wherein said first bore has a greater effective area than the effective area of said second bore; and a piston rod connected to said second piston and extending through an opening formed through an end wall of said second bore; said third piston having an axial length to always remain at least partially within said second bore throughout its realm of reciprocal movement.

19. The reciprocatory motor of claim 18 further comprising a hydraulic fluid reservoir and a fluid line communicating said first bore with said hydraulic fluid reservoir.

20. The reciprocatory motor of claim 19 further comprising a valve arrangement along said fluid line communicating said first bore with said hydraulic fluid reservoir.

21. The reciprocatory motor of claim 20 further comprising means for selectively pressurizing said first and second bores for effecting movement of said first, second and third pistons.

22. The reciprocatory motor of claim 21 wherein said selective pressurizing means comprises a hydraulic circuitry arrangement in communication with said first and second bores.

23. The reciprocatory motor of claim 22 wherein said valve arrangement includes a valve which selectively prohibits and permits fluid flow along said fluid line communicating said first bore with said hydraulic fluid reservoir in response to pressure within a region of said hydraulic circuitry arrangement.

24. The reciprocatory motor of claim 23 wherein said first bore is coaxially disposed with respect to said second bore.

25. The reciprocatory motor of claim 24 wherein said first piston has a greater effective hydraulic fluid contacting surface area than either of said second and third pistons.

26. The reciprocatory motor of claim 25 wherein said first piston is provided with an opening located centrally through its lengthwise axis.

27. The reciprocatory motor of claim 26 further comprising a valve means providing communication between opposite sides of second piston.

28. The reciprocatory motor of claim 27 wherein said hydraulic circuitry arrangement is effective to exert the same pressure on said first, second and third pistons so that said first piston disposed within said first bore moves at a slower rate and at a higher force than said second and third members disposed within said second bore.

29. The reciprocatory motor of claim 18 wherein said first, second and third pistons are slidable independently with respect to one another.

30. The reciprocatory motor of claim 29 further comprising a cylindrical housing in which said first and second bores are located, and wherein a substantial quantity of an axially directed portion of the inner wall of said first bore overlaps, and is positioned radially outward and apart from, a substantial quantity of an axially directed portion of said second bore so that the length of said housing is compact.

31. The reciprocatory motor of claim 30 wherein said first piston is provided with an opening located centrally through its lengthwise axis.

* * * * *